United States Patent [19]

Tirtiaux et al.

[11] 4,259,193

[45] Mar. 31, 1981

[54] OVERBASED SULPHONATES

[75] Inventors: Robert Tirtiaux, Mont Saint Aignan; Robert M. Laurent, Bois Guillaume, both of France

[73] Assignee: Exxon Research & Engineering Co., Florham Park, N.J.

[21] Appl. No.: 29,997

[22] Filed: Apr. 16, 1979

Related U.S. Application Data

[63] Continuation of Ser. No. 930,564, Aug. 3, 1978, abandoned.

[30] Foreign Application Priority Data

Aug. 4, 1977 [GB] United Kingdom ..... 32725/77

[51] Int. Cl.[3] ..... C10M 1/40; C10M 1/10; C10M 3/34; C10M 3/02

[52] U.S. Cl. ..... 252/33

[58] Field of Search ..... 252/33

[56] References Cited

U.S. PATENT DOCUMENTS

| | | | |
|---|---|---|---|
| 2,174,246 | 9/1939 | Lieber et al. | 196/78 |
| 2,244,512 | 6/1941 | Brandt | 260/505 |
| 2,281,941 | 5/1942 | Lieber | 196/78 |
| 2,340,654 | 2/1944 | Flett | 260/505 |
| 2,364,782 | 12/1944 | Flett | 260/505 |
| 2,437,356 | 3/1948 | Hill | 260/671 |
| 2,499,578 | 3/1950 | Flett | 260/505 |
| 2,688,643 | 9/1954 | Dean | 260/671 |
| 2,712,530 | 7/1955 | Baumgartner | 252/161 |
| 2,875,082 | 2/1959 | Tench | 106/270 |
| 3,031,284 | 4/1962 | Andress | 44/76 |
| 3,070,636 | 12/1962 | Kieras | 260/660 |
| 3,410,925 | 11/1968 | Eby et al. | 260/683.15 |
| 3,422,161 | 1/1969 | Lavigne et al. | 260/668 |
| 3,764,533 | 10/1973 | Hunt et al. | 252/33 |
| 3,865,737 | 2/1975 | Kemp | 252/33 |
| 3,867,296 | 2/1975 | Hunt | 252/33 |
| 3,896,037 | 7/1975 | Dickey | 252/33.4 |
| 3,952,803 | 4/1976 | Kerfoot et al. | 252/33 |
| 4,153,627 | 5/1979 | Delbende et al. | 252/33 |

*Primary Examiner*—Delbert E. Gantz
*Assistant Examiner*—Irving Vaughn
*Attorney, Agent, or Firm*—Frank T. Johmann

[57] ABSTRACT

Overbased alkaline earth metal sulphonates obtained from monoalkyl orthoxylene or toluene have been found to have reduced foaming tendency as compared with corresponding benzene based sulphonates.

7 Claims, 1 Drawing Figure

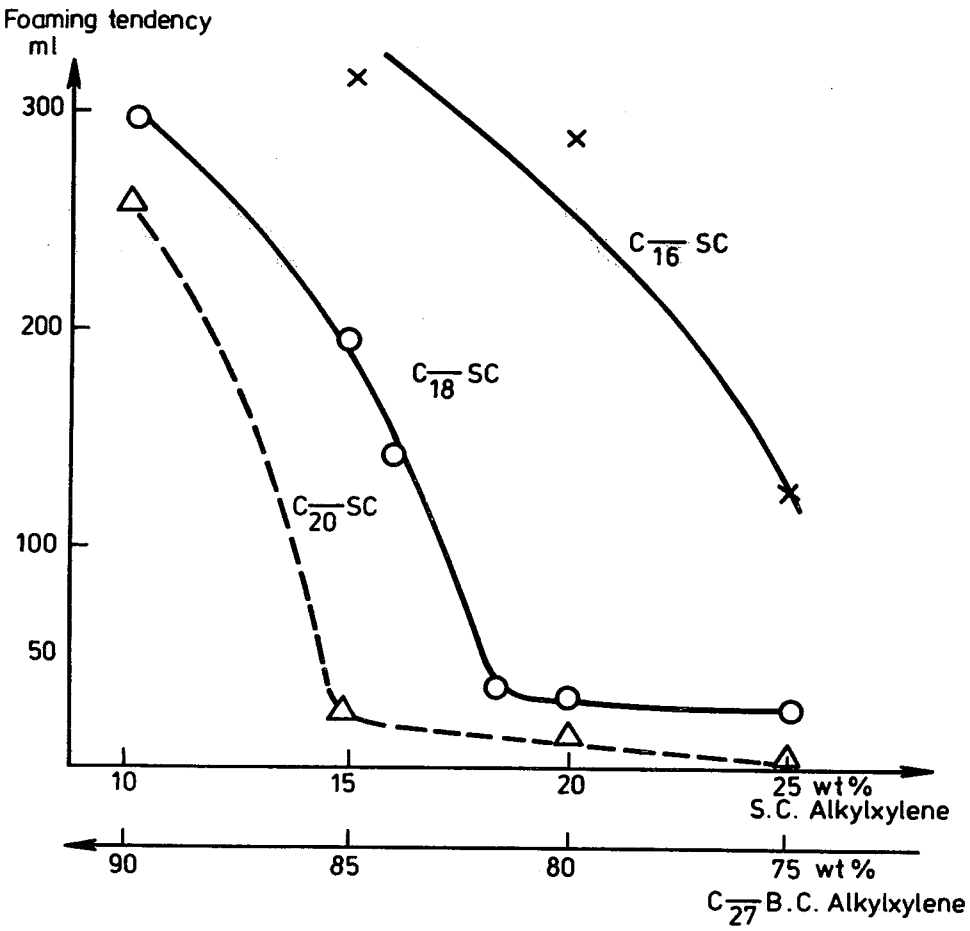
Foaming tendency
ml
300
200
100
50
10
15
20
25 wt%
S.C. Alkylxylene
90
85
80
75 wt%
C 27 B.C. Alkylxylene
C 16 SC
C 18 SC
C 20 SC

OVERBASED SULPHONATES

This is a continuation of application Ser. No. 930,564, filed 8/3/78, abandoned.

The present invention relates to improved overbased alkaryl sulphonates especially overbased calcium sulphonates which have a reduced tendency to cause foaming when they are used as lubricant additives.

Sulphonates, particularly calcium, barium or magnesium overbased sulfonates are widely used as additives for lubricating oils. The term overbased is used to describe sulphonates contaning an amount of metal in excess of that required to react with the sulphonic acid from which the sulphonate is obtained. Frequently the excess metal is in the form of its carbonate and the overbased sulphonate consists of a colloidal dispersion of the metal carbonate in the metal sulphonate as dispersant. These overbased sulphonates are used in lubricating oils where their high basicity neutralises acids which develop in crankcases during engine operation thus reducing corrosion and their surfactant effect helps to retain sediments in the oil rather than forming unwanted deposits.

Overbased sulphonates are generally obtained from sulphonic acids derived from mono-alkylates of benzene, the alkyl chain being either branched or straight chain. The oil soluble sulphonic acids are usually obtained from alkylates containing an alkyl group of more than 16, generally more than 20, carbon atoms generally the alkyl group is branched chain since the branched chain olefins used in the preparation of these alkylates are more readily available and cheaper than the corresponding straight chain olefins. It has also been proposed as for example in U.S. Pat. No. 3,764,533 to produced overbased sulphonates from straight chain dialkyl aromatic sulphonic acids including dialkyl benzene, xylene and toluene sulphonic acids. We have found however that dialkyl aromatics are more difficult to sulphonate than monoalkyl aromatics particularly when using our preferred technique of sulphonation with a mixture of sulphur dioxide and sulphur trioxide where large amounts of unwanted sludge are formed during the sulphonation reaction. This problem is particularly marked when using branched chain alkyl aromatics with which we are particularly but not exclusively concerned.

However, one problem associated with the use of overbased sulphonates particularly overbased sulphonates obtained from branched chain alkyl benzenes is that despite the inclusion of an antifoam agent in the oil they tend to cause foaming of the lubricant during operation of the engine which is undesirable. With the current tendency to use highly paraffinic, higher viscosity oils for lubricants rather than the previously used naphthenic oils the problems of foaming of oils are increased as are the problems of solubility of overbased sulphonates in the oils. These problems are particularly marked with overbased calcium alkyl benzene sulphonates. We have now found that the foaming problems are significantly reduced if the aryl group of the sulphonic acid is orthoxylene or toluene and that in certain instances improved oil solubility is achieved with the orthoxylene and toluene based sulphonates.

The term "mono-alkyl" as used in this specification refers to the alkyl group containing from 15 to 40 carbon atoms and does not refer to the methyl groups of the toluene or orthoxylene nucleus.

The present invention therefore provides an overbased alkaline earth metal mono-alkylaryl sulphonate in which the alkylaryl moiety is a mono-alkyl orthoxylene or a mono-alkyl toluene and the alkyl group contains from 15 to 40 carbon atoms.

The mono-alkyl orthoxylene or mono-alkyl toluene used in the production of the overbased sulphonates of the present invention may be prepared by any of the well-known alkylation techniques. Our preferred technique being the use of a Friedel Crafts catalyst such as aluminum trichloride preferably together with hydrochloric acid. The alkyl group may be straight chain or branched although since branched chain olefines are generally cheaper than straight chain olefines the branched chain monalkylates are preferred.

In a preferred embodiment of the invention the mono-alkylorthoxylene or mono-alkyl toluene is prepared by alkylating xylene or toluene with a mixture of branched and linear olefines according to our German Patent Application No. 2803420. This preferred embodiment further reduces the foaming tendency of the overbased sulphonate and we prefer that the olefine mixture used as the feed contains at least 5 wt. % of the linear olefine. We also find that there is no further improvement in effect if the mixture contains more than 30 wt. % of the linear olefine. Thus, since linear olefines tend to be more expensive than branched chain olefines we prefer that the mixture contain from 5% to 30% by weight of the linear olefine. The mono-alkyl group should contain from 15 to 40 carbon atoms to give oil solubility preferably the mono-alkyl group contains from 18 to 30 carbon atoms most preferably 18 to 27 and is conveniently an oligomer of propylene. In all instances an excess, frequently a large excess of orthoxylene or toluene in present during the alkylation reaction to ensure that the product of alkylation is mono-alkyl. The excess can be recycled for subsequent alkylation reactions.

Any of the well-known sulphonation techniques may be used to convert the alkyl orthoxylenes and alkyl toluenes to sulphonic acids. For example the alkylate may be sulphonated with concentrated sulphuric acids, with oleum or with sulphur trioxide dissolved in sulphur dioxide, this latter technique being preferred. After sulphonation the sulphonic acid is purified by standard techniques or purifying aids such as the addition of olefins and optionally water as described in our U.K. application No. 6775/76 corresponding to U.S. Pat. No. 4,153,627 may be included.

The alkaline earth metal of the sulphonates of the present invention may be magnesium, calcium or barium but the invention is particularly concerned with overbased calcium sulphonates which present particular foaming problems when used as lubricant additives. We have found that the calcium sulphonates of our invention have acceptable foam levels when used with conventional antifoam additives which is not the situation with sulphonates based on other aryl nucleii, especially benzene. Furthermore we find that in some instances the antifoam additives may not be needed in lubricants containing our overbased calcium sulphonate.

The term overbased is used in this specification to describe materials containing a stoichiometric excess of the alkaline earth metal over and above that required to neutralise the sulphonic acid. These materials generally exist as a salt of the metal suspended in oil by means of the metal salt of the sulphonic acid which acts as surfactant. Preferably the metal salt is the carbonate and is produced by carbonating a mixture of oil, optionally a solvent, sulphonic acid, the metal oxide or hydroxide in excess and reaction promoters. Many processes have been proposed in the patent literature for the production of overbased alkaline earth metal mono-alkyl benzene sulphonates and any of these may be used in the preparation of the products of our invention, particularly preferred processes are those described in our British Pat. No. 1299253, our Canadian Pat. No. 894412 and our copending U.K. application No. 27932/77 corresponding to U.S. application Ser. No. 921,107, abandoned 6/9/80. A continuing application Ser. No. 31,383 was filed 3/17/80 based on Ser. No. 921,107.

The alkaline earth metal sulphonates of our invention are useful as additives for lubricating oils where they may be used in the amounts traditionally used and in combination with other well-known additives such as the polyamine dispersants, copolymeric viscosity index modifiers and antiwear additives such as zinc dialkyl dithiophosphate. We have found that the use of the sulphonates of this invention yields lubricating oils with reduced foaming tendency as compared with oils containing currently available alkyl-benzene sulphonates. We have found that although sulphonates derived from toluene have reduced foaming tendencies the reduction is greater with corresponding sulphonates derived from xylene. However the use of toluene has the advantage that it is easier to alkylate than orthoxylene and is also cheaper. We have found that some oils containing sulphonates of our invention have such a reduced foaming properties that the anti-foam agent traditionally used in lubricating oils may not be needed. However we generally prefer to include an antifoam agent such as the commercially available silicones in an amount up to 1000 parts per million preferably up to 500 parts per million based on the lubricating oil.

The present invention is illustrated but in no way limited by the following Examples.

EXAMPLE 1

An excess of orthoxylene and toluene were alkylated with one mole of a $C_{24}$ average propylene oligomer by a conventional alkylation process using an $AlCl_3$ catalyst at 0° C. The monoalkyl product was purified by distillation to leave a bottom boiling above 330° C. and this was sulphonated with sulphur trioxide dissolved in sulphur dioxide.

Then 2.8 grams of the sulphonic acid so obtained were blended with 10 grams of a high base number alkyl benzene calcium sulphonate of Total Base Number (TBN) 300 Mg KOH/gram to yield an overbased sulphonate of TBN 250. 5 wt. % of overbased sulphonate was incorporated into the commercially available reference oil SIS 3453 which was compared with a product prepared in an identical manner from benzene in the comparative foam test ASTM D 892.

The foam test results were as follows:

| | Foaming Tendency | | |
|---|---|---|---|
| Aromatic Ring | No Antifoam | 2000 ppm Antifoam | 400 ppm Antifoam |
| Benzene | 650/500 | 650/500 | 650/500 |
| Toluene | 650/470 | 630/120 | 600/100 |
| Ortho-Xylene | 600/340 | 500/20 | 420/20 |

The anti-foam used was the DC 200 silicone obtained from the Dow Chemical Co. These results, which are comparative, show the reduction in foaming tendency using the toluene and ortho-xylene derived sulphonates.

EXAMPLE 2

Orthoxylene and Benzene were alkylated with a $C_{24}$ average polyisobutylene the alkylate sulphonated and the sulphonic acid converted to an overbased calcium sulphonate by the techniques of Example 1. The results of the foam tests on lubricants containing 5 wt. % of the overbased sulphonate were as follows:

| | Foaming Tendency | |
|---|---|---|
| Aromatic Ring | No Antifoam | 400 ppm Antifoam |
| Benzene | 630/360 | 540/220 |
| Ortho-Xylene | 600/70 | 400/T |

T signifies that only a trace of foam is produced during the test.

EXAMPLE 3

Orthoxylene was alkylated by the process of Example 1 with various mixtures of branched and straight chain olefines and the resulting alkylates sulphonated with oleum and converted into overbased calcium sulphonates as in Example 1.

In each instance the branched chain olefine was a $C_{27}$ olefine which was blended with differing amounts of $C_{16}$, $C_{18}$ and $C_{20}$ straight chain alkylates.

The foaming properties of oils containing 5 wt. % of the overbased sulphonates were measured by the ASTM D 892 method and the results are set out in the graph which is attached hereto as FIG. 1.

FIG. 1 measures the foaming tendency in terms of milliliters of foam of blends of 90–75 weight percent of the $C_{27}$ branched chain ($C_{27}$-B.C.) alkylxylene with 10–25 weight percent of a straight chain (S.C.) alkylxylene wherein the straight chain is either a $C_{20}$ straight chain, a $C_{18}$ straight chain or a $C_{16}$ straight chain.

EXAMPLE 4

Both benzene and ortho-xylene were alkylated with a mixture containing 80 wt. % of a $C_{27}$ branched chain olefine and 20 wt. % of a $C_{20}$–$C_{24}$ straight chain olefine.

The alkylates obtained were sulphonated and converted to overbased calcium sulphonates as in Example 1 the foaming tendency of lubricants containing 5 wt. % of the overbased calcium sulphonate was measured by ASTM D 892. Comparisons were made between lubricants containing 400 parts per million of antifoam and lubricant free of antifoam.

The test results were as follows:

| | Foaming Tendency | |
|---|---|---|
| Aromatic Ring | without Antifoam | with Antifoam |
| Benzene | 470/T | 20/0 |
| Ortho-Xylene | 20/T | T/0 |

EXAMPLE 5

Example 4 was repeated with benzene, ortho-xylene and toluene and replacing the olefine mixture with a mixture containing 80 wt. % of a $C_{24}$ branched chain olefine and 20 wt. % of a $C_{18}$ straight chain olefine.

The foam test results were as follows:

| Aromatic Ring | Foaming Tendency without Antifoam | with 400 ppm Antifoam |
|---|---|---|
| Benzene | 650/50 | 50/0 |
| Toluene | 150/0 | T/0 |
| Ortho-xylene | 30/0 | T/0 |

EXAMPLE 6

The process of Example 5 was repeated replacing the olefine mixture with a mixture containing 85 wt. % of the $C_{24}$ branched chain olefine and 15 wt. % of the $C_{18}$ straight chain olefine.

The foam test results were as follows:

| | without Antifoam | with 40 ppm Antifoam |
|---|---|---|
| Benzene | 600/60 | 200/0 |
| Toluene | 400/0 | T/0 |
| Xylene | 220/0 | T/0 |

EXAMPLE 7

Orthoxylene was alkylated with a mixture of 80 wt. % of a $C_{27}$ branched chain olefine and 20 wt. % of a $C_{18}$ straight chain olefine. The alkylate was sulphonated with oleum and the sulphonic acid obtained was converted into a 300 TBN overbased calcium sulphonate by the process of our British Pat. No. 1299253.

The product was compared with a 300 TBN calcium sulphonate prepared by the same process from a $C_{24}$ branched chain alkyl benzene and the properties were as follows:

| | $C_{24}$ Alkyl Benzene | 80% $C_{27}$ Branched Chain 20% $C_{18}$ Straight Chain Alkyl Orthoxylene |
|---|---|---|
| Viscosity at 210° F. | 60 | 47 |
| Solubility at 5 wt.% in a paraffinic mineral oil of viscosity 600 S.U.S. at 100° F. | Hazy | Soluble |
| Foaming Tendency in SIS 3453 (ASTM D 892) | 600/500 | 40/0 |

The foam tests were carried out on a mineral oil solution containing 5 wt. % of the overbased sulphonate and no anti-foam additive.

EXAMPLE 8

300 TBN sulphonates were prepared from alkyl toluene and alkyl-orthoxylene using the alkylation, sulphonation techniques of Example 7, and the overbasing process as described in our copending U.K. application No. 27932/77.

The solubility of these sulphonates at 5 wt. % in various paraffinic mineral oils was found to be as follows:

| Oil | Ortho-xylene Based | Toluene Based |
|---|---|---|
| A. Viscosity 600 SSU at 100° F. | Clear | Clear |
| B. Viscosity 2500 SSU at 100° F. | Clear | Borderline |
| C. 50% A + 50% B | Clear | Hazy |

The foaming tendency in the ASTM D 89 test using the SIS 3453 reference oil and 100 p.p.m. of the silicone antifoam used in Example 1 was as follows.

| Ortho-xylene Based | Toluene Based |
|---|---|
| T/O | 50/10 |

We claim:

1. A lubricating oil composition containing an overbased alkaline earth metal mono-alkylaryl sulphonate in which the alkylaryl moiety is mono-alkyl orthoxylene or mono-alkyl toluene and the alkyl group contains from 15 to 40 carbon atoms prepared by alkylating orthoxylene or toluene with a mixture of branched and linear olefins which contains 5 to 30% by weight of said linear olefin.

2. A lubricating oil composition according to claim 1, wherein said alkaline earth metal is calcium.

3. A lubricating oil composition according to claim 2, wherein said alkyl group contains 18 to 30 carbon atoms.

4. A lubricating oil composition according to claim 2, wherein said alkyl group contains 18 to 27 carbon atoms.

5. A lubricating oil composition according to claim 4, wherein said alkylaryl moiety is said mono-alkyl orthoxylene.

6. A lubricating oil composition according to claim 4, wherein said alkylaryl moiety is said mono-alkyl toluene.

7. A lubricating oil composition according to claim 4, wherein said branched olefin is selected from the group consisting of polypropylene and polyisobutylene.

* * * * *